US007210475B2

(12) United States Patent
Barnes et al.

(10) Patent No.: US 7,210,475 B2
(45) Date of Patent: May 1, 2007

(54) LOW PROFILE GAS BURNER FOR A COOKING APPLIANCE

(75) Inventors: Shelton T. Barnes, Chattanooga, TN (US); Eddie Max Brock, Cleveland, TN (US); Christopher A. Larsen, Dorchester, MA (US); Gerald R. Place, East Ridge, TN (US)

(73) Assignee: Maytag Corporation, Newton, IA (US)

( * ) Notice: Subject to any disclaimer, the term of this patent is extended or adjusted under 35 U.S.C. 154(b) by 741 days.

(21) Appl. No.: 10/385,520

(22) Filed: Mar. 12, 2003

(65) Prior Publication Data

US 2004/0177845 A1 Sep. 16, 2004

(51) Int. Cl.
*F24C 15/00* (2006.01)
*F24C 15/32* (2006.01)

(52) U.S. Cl. ..... 126/273 R; 126/39 R; 126/19 R

(58) Field of Classification Search ..... 126/273 R, 126/39 R, 19 R
See application file for complete search history.

(56) References Cited

U.S. PATENT DOCUMENTS

| | | | | |
|---|---|---|---|---|
| 1,908,668 | A * | 5/1933 | Hollman | 431/286 |
| 3,386,431 | A * | 6/1968 | Branson | 126/39 R |
| 3,422,809 | A * | 1/1969 | Perry | 126/21 A |
| 4,796,600 | A * | 1/1989 | Hurley et al. | 126/273 A |
| 5,937,846 | A * | 8/1999 | Martin et al. | 126/39 E |

* cited by examiner

*Primary Examiner*—Alfred Basichas
(74) *Attorney, Agent, or Firm*—Diederiks & Whitelaw, PLC

(57) ABSTRACT

A gas cooking appliance includes a low profile gas burner assembly positioned within an oven cavity. The low profile gas burner assembly, formed from a tubular member having a defined diameter, includes a first end, defining an inlet portion, interconnected with a second end, defining an outlet portion, through an intermediate portion. In accordance with the invention, the intermediate portion maintains a vertically spaced relationship between the inlet portion and outlet portion from about 1.0 to 3.33 times the diameter of the tubular member, preferably about 1.33 to 2.66 times the diameter and, most preferably, approximately twice the diameter of the tubular member.

14 Claims, 3 Drawing Sheets

LOW PROFILE GAS BURNER FOR A COOKING APPLIANCE

BACKGROUND OF THE INVENTION

1. Field of the Invention

The present invention pertains to the art of cooking appliances and, more particularly, to a cooking appliance incorporating a low profile gas burner assembly.

2. Discussion of the Prior Art

In general, it is known to utilize gas as a heat source in a cooking appliance. Typically, the gas heat source is in the form of a gas burner assembly located at a bottom portion of an oven cavity, either out in the open or, below a false bottom panel. In some cases, another gas burner assembly is positioned in an upper portion of the oven cavity for broiling operations. In any event, oven designs require sufficient space to accommodate one or more gas burner assemblies.

Conventionally, oven cavities are designed with a considerable amount of space allocated for the gas burner assembly. In a manner known in the art, inlet and outlet portions of the gas burner assembly are maintained in a well defined spaced relationship. More specifically, a conventional gas burner assembly is designed such that a vertical distance of at least 3 inches (7.62 cm) separates the inlet portion from the outlet portion. This distance requirement has been seen as necessary to avoid the negative effects associated with a reverse density driven flow which occurs when the cooking appliance is hot and gas flow to the burner is off. In the event of a reverse density driven flow, combustion of the gas takes place at the inlet portion of the burner assembly and not at gas discharge ports arranged along the outlet portion.

Unfortunately, while effective at eliminating adverse effects of the reverse density driven flow, the space between the inlet and outlet means that more space is needed for the burner assembly which, in turn, disadvantageously results in a reduction in oven cavity size. This is especially true in dual oven ranges wherein the space required to accommodate multiple gas burner assemblies in two oven cavities reduces the overall space available within each oven cavity. In the highly competitive field of cooking appliances, manufacturers often desire to provide more space, in smaller packages, to attract the buying public. Therefore, based on the above, there exists a need in the art for a cooking appliance designed to enable an enhanced oven cavity size. More specifically, there exists a need in the art for a low profile gas burner assembly designed to establish an enlarged oven cavity. Particularly, there exists a need for a low profile gas burner assembly having an inlet portion and an outlet portion separated by a distance less than the conventional 3 inches (7.62 cm) that does not suffer from the effects of a reverse density driven flow.

SUMMARY OF THE INVENTION

The present invention is directed to a cooking appliance including a low profile gas burner assembly. In accordance with a preferred embodiment of the invention, the cooking appliance includes a cabinet, first and second oven cavities arranged within the cabinet, and at least one gas burner assembly positioned within each of the first and second oven cavities. More specifically, the gas burner assembly includes a first end, defining an inlet portion, interconnected with a second end, defining an outlet portion having arranged thereon a plurality of gas discharge ports, through an intermediate portion. The gas burner assembly is formed from a tubular member having a defined diameter. In general, the intermediate portion maintains a distance up to several times the diameter of the tubular member between the inlet and outlet portion. More specifically, the intermediate portion maintains a vertically spaced relationship between the inlet portion and outlet portion of at least one tubing diameter and, more preferably, two tubing diameters. For example, with a 0.75 inch (1.91 cm) diameter tube, the inlet and outlet portions are spaced from 0.75 inches (1.91 cm) to about 2.5 inches (6.35 cm), preferably 1 inch (2.54 cm) to about 2.0 inches (5.08 cm) and, most preferably approximately 1.5 inches (3.81 cm).

In any event, additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
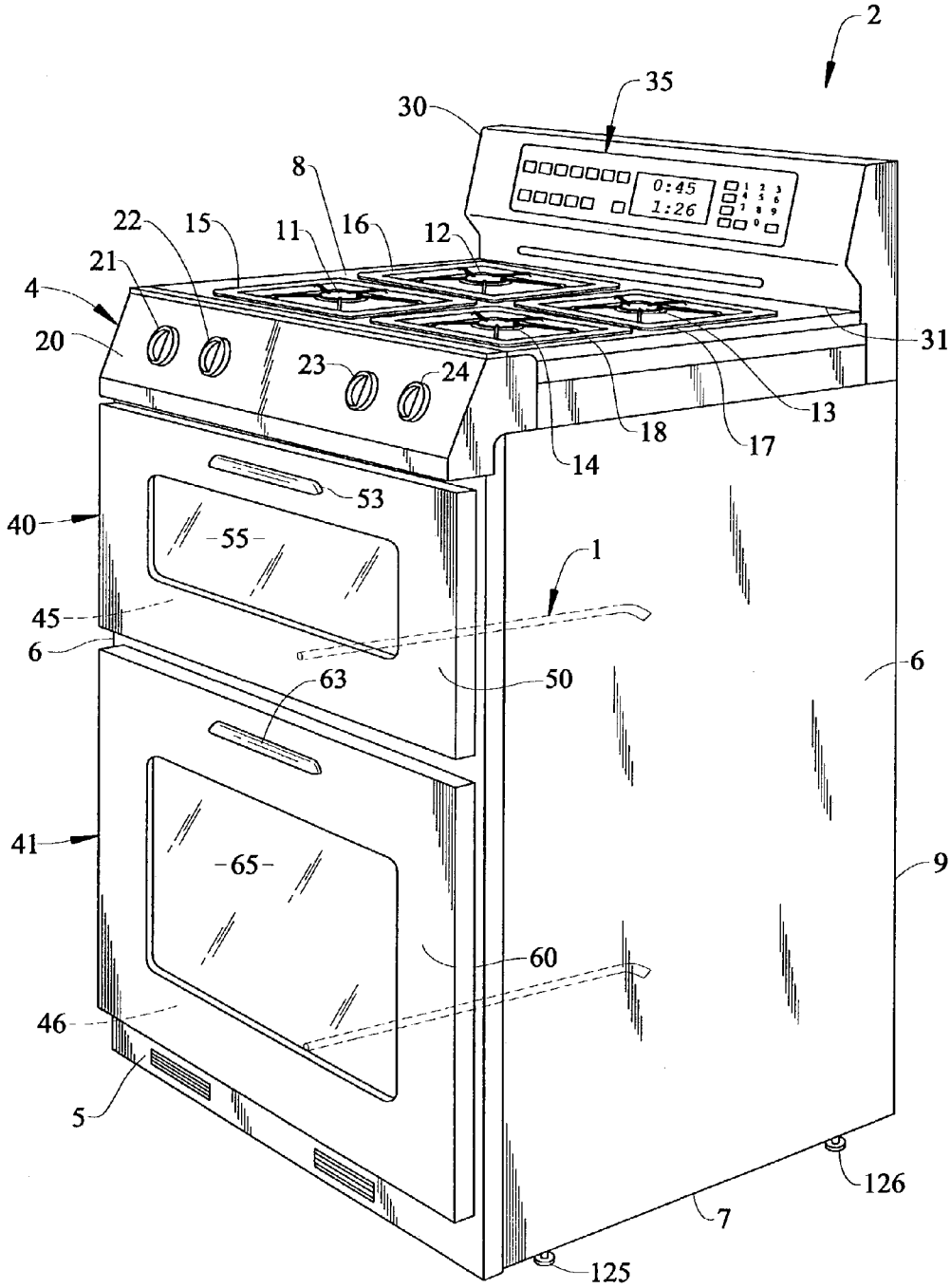
FIG. 1 is a perspective view of a cooking appliance incorporating a low profile gas burner assembly constructed in accordance with a preferred embodiment of the present invention.

With initial reference to FIG. 1, a low profile gas burner arrangement 1 constructed in accordance with the present invention is shown incorporated into a cooking appliance generally indicated at 2. As shown cooking appliance 2 takes the form of a free-standing gas range unit. Cooking appliance or range 2 includes a cabinet 4 having a front panel portion 5, side panel portion 6, bottom portion 7, a range top 8 and main back panel 9. In a manner known in the art, range top 8 can take on various forms. Specifically, in the embodiment shown, range top 8 is shown as a gas cooktop incorporating various gas burner elements 11–14, and associated burner grates 15–18. As shown, range 2 further includes a front control surface 20 which preferably supports a plurality of control knobs 21–24 for controlling the activation/deactivation of gas burners 11–14 respectively. Furthermore, range 2 includes a rear, upstanding control panel 30 arranged at an upper rear portion of cabinet 4. In the embodiment shown, control panel 30 includes a central control and display unit, generally indicated at 35, for use in controlling a first or upper oven 40 and a second or lower oven 41.

Preferably, upper oven 40 includes a respective first or upper oven cavity 45 and, similarly, lower oven 41 includes a respective second or lower oven cavity 46. In a manner known in the art, upper oven 40 has associated therewith a door 50 which can be pivoted by means of a handle 53. Door 50 preferably includes a window 55 for viewing the contents of upper oven cavity 45. In a similar manner, lower oven 41 has associated therewith a door 60, a handle 63 and a window 65. Furthermore, as best seen in FIG. 2, in order to maintain a heated atmosphere within upper and lower oven cavities 40 and 41, each cavity 40, 41 is wrapped in a respective insulation blanket 80, 82.

In a manner known in the art, range 2 is adapted to rest upon a supporting surface, such as a kitchen floor or the like. More specifically, a plurality of leg members, two of which are indicated in FIGS. 1 and 2 at 125 and 126, extend from bottom portion 7 at front and rear portions of cabinet 4 along side panel 6. Of course, corresponding leg members are also provided on the opposing side of range 2. In any event, the various leg members 125 and 126 are preferably vertically adjustable to also act as levelers for range 2. Such type of leg leveler arrangements are widely known in the art of appliances, including ranges and refrigerators, such that the leveling function of leg members 125 and 126 does not form part of the present invention.

In general, the structure described above with respect to range 2, with the exception of the particular construction of burner arrangement 1, is already known in the art and does not constitute part of the present invention. Therefore, this structure has only been described for the sake of completeness. Instead, the present invention is particularly directed to gas burner arrangement 1 which is adapted to establish a heated cooking environment within a respective one of oven cavities 45 and 46. More specifically, gas burner arrangement 1 is of a low profile type which does not require a significant amount of space that would otherwise detract from the space available for conducting various cooking operations as will be detailed fully below.

Figure 2:
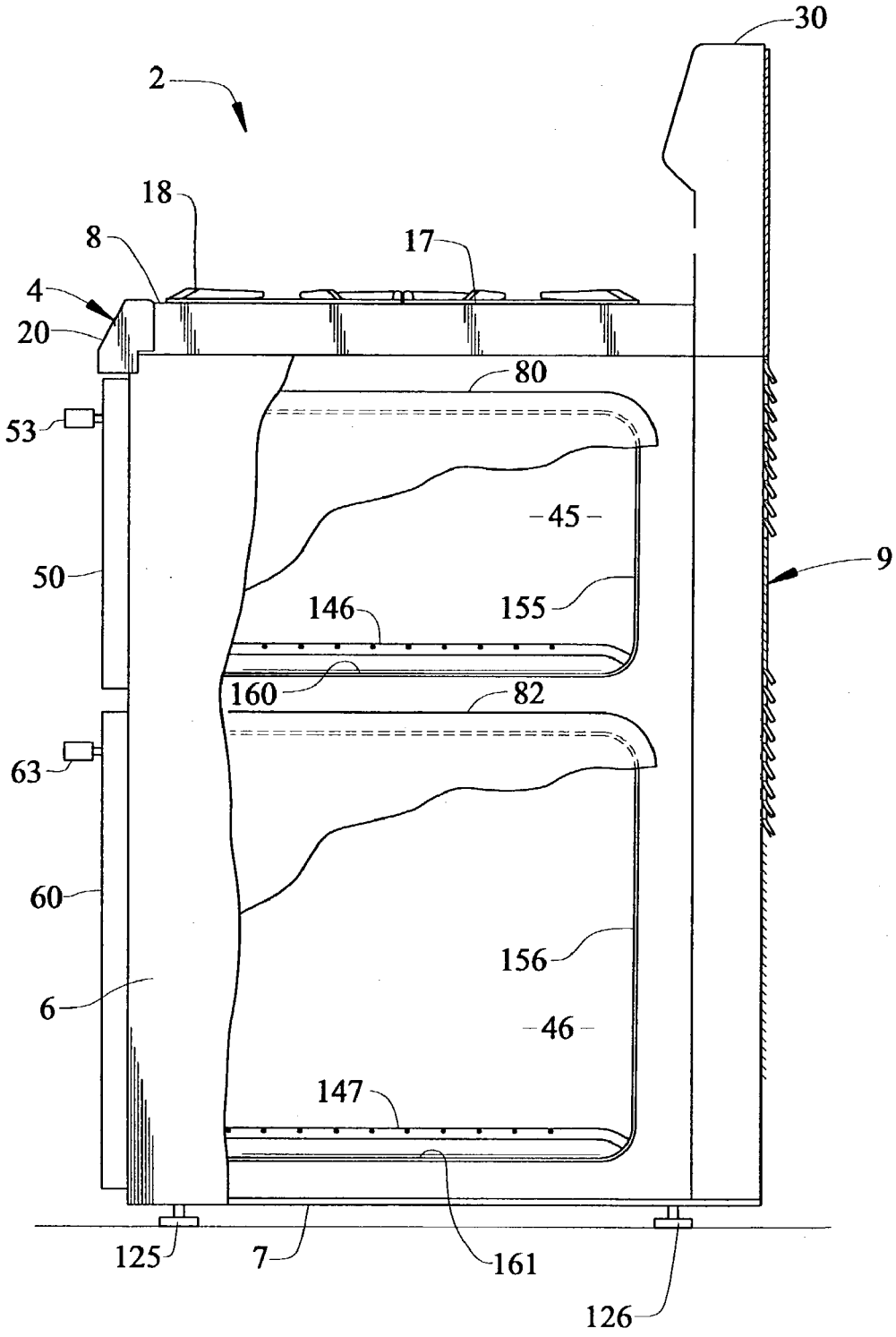
FIG. 2 is a partial, cross-sectional side view of the cooking appliance of FIG. 1.

Referring to FIG. 2, arranged within upper oven cavity 45 is a first or upper gas burner assembly 146. Similarly, a second or lower gas burner assembly 147 is positioned within lower oven cavity 46. As shown, upper gas burner assembly 146 extends from a rear portion 155 of upper oven cavity 45, while lower burner assembly 147 extends from a rear portion 156 of lower oven cavity 46. At this point, it should be understood that, while upper and lower gas burner assemblies 146 and 147 are shown extending from respective rear portions 155 and 156 of oven cavities 45 and 46, gas burner assemblies 146 and 147 could alternatively extend through respective lower portions 160 and 161 of oven cavities 45 and 46, and/or arranged below false bottoms (not shown). Moreover, in addition to upper and lower gas burner assemblies 146 and 147, other gas burner assemblies (not shown) could be arranged in upper portions of oven cavities 45 and 46 for use in connection with performing broiling operations.

Figure 3:
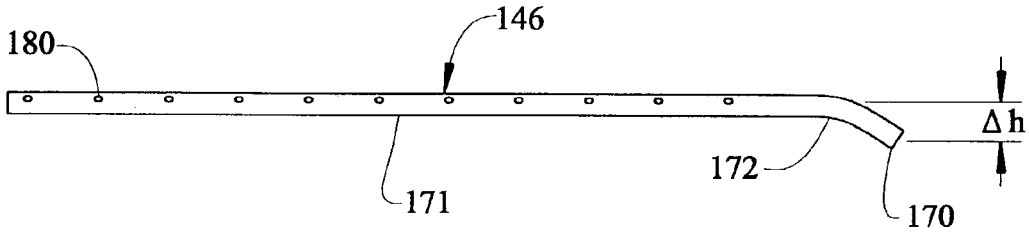
FIG. 3 is an enlarged, elevational side view of the low profile gas burner assembly of the present invention.

Reference will now be made to FIG. 3 in describing the preferred embodiment of upper and lower gas burner assemblies 146 and 147. Since the structure of each gas burner assembly is identical, a detailed description of upper gas burner assembly 146 will be made and it is to be understood that lower gas burner assembly 147 has commensurate structure. As shown, upper gas burner assembly 146 includes a first or inlet portion 170 interconnected with an elongated second or outlet portion 171 through an intermediate portion 172. As further shown in FIG. 3, extending along outlet portion 171 are a plurality of gas discharge ports, one of which is indicated at 180.

In accordance with the present invention, intermediate portion 172 maintains a vertically spaced relationship between inlet portion 170 and outlet portion 171 as represented by $\Delta h$ in FIG. 3. As will be discussed more fully below, in accordance with the invention, the spaced relationship is from at least one tubing diameter to several times the tubing diameter and, more preferably, twice the tubing diameter.

Figure 4:
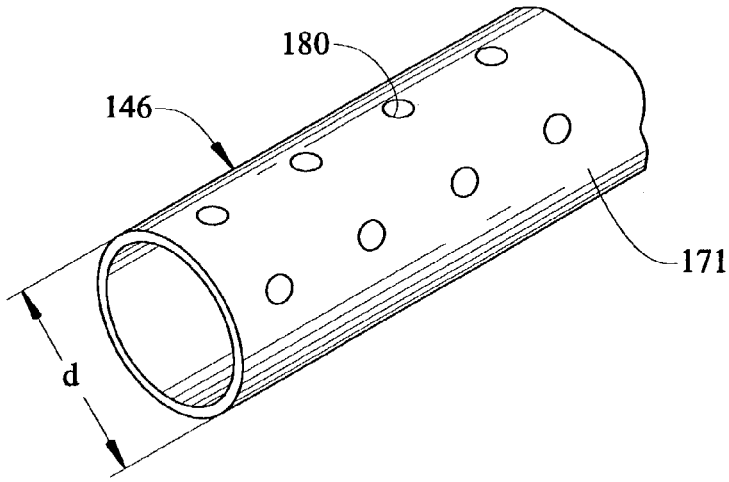
FIG. 4 is a partial, cross-sectional view of a portion of the low profile gas burner assembly of FIG. 3.

In further accordance with the present invention, as shown best in FIG. 4, upper gas burner assembly 146 is defined by a tubular member having a defined diameter as indicated at "d" along outlet portion 171. In accordance with the most preferred embodiment of the invention, intermediate portion 172 maintains a spaced relationship between inlet portion 170 and outlet portion 172 measured at a distance being about twice the diameter d of outlet portion 171. That is, with an exemplary tubing diameter of 0.75 inches (1.91 cm), the inlet and outlet portions 170 and 171 are vertically spaced from 0.75 inches (1.91 cm) to about 2.5 inches (6.35 cm). In a more preferred form of the invention, the spaced relationship is maintained from about 1 inch (2.54 cm) to about 2 inches (5.08 cm). In the most preferred form of the invention, the spaced relationship is maintained at a distance of approximately 1.5 inches (3.81 cm). In other words, the spaced relationship ranges from about 1.0 to 3.33 times the tubing diameter, preferably from about 1.33 to 2.66 times the tubing diameter and, most preferably, 2.0 times the diameter. Constructing gas burner assemblies 146 and 147 in this fashion has been found to minimize the height thereof in order to enhance the sizes of oven cavities 45 and 46 without increasing the overall size of cabinet 4. Surprisingly though, low profile gas burner arrangement 1 has been found to avoid any reverse density driven flow.

Although described with reference to a preferred embodiment of the present invention, it should be readily apparent of one of ordinary skill in the art that various changes and/or modifications can be made to the invention without departing from the spirit thereof. For instance, while the low profile gas burner arrangement of the present invention is shown incorporated into a dual oven range, it should be understood that the present invention could be incorporated into various other gas cooking appliances, including ranges with a single oven cavities, wall ovens and the like. Also while the gas cooktop is shown with exposed gas burners and grates, the burners could be positioned below a glass/ceramic surface and the grate eliminated. In general, the invention is only intended to be limited by the scope of the following claims.

We claim:

1. A cooking appliance comprising:

an oven cavity; and a gas burner assembly positioned within the oven cavity, said gas burner assembly including a first end, defining an inlet portion, interconnected with a second end, defining an elongated outlet portion, through an intermediate portion, wherein said intermediate portion maintains a vertically spaced relationship between the inlet portion and outlet portion, said spaced relationship being from about 0.75 inches (1.91 cm) to about 2.5 inches (6.35 cm).

2. The cooking appliance according to claim 1, wherein said spaced relationship is from about 1 inch (2.54 cm) to about 2.0 inches (5.08 cm).

3. The cooking appliance according to claim 2, wherein the spaced relationship equals approximately 1.5 inches (3.81 cm).

4. The cooking appliance according to claim 1, wherein the outlet portion is defined by a hollow tube having a diameter, said intermediate portion maintaining the spaced relationship between the inlet portion and the outlet portion to approximately twice the diameter.

5. The cooking appliance according to claim 1, further comprising: a plurality of gas discharge ports arranged along the outlet portion of the gas burner assembly.

6. The cooking appliance according to claim 1, wherein the cooking appliance includes another oven cavity below said oven cavity.

7. The cooking appliance according to claim 6, wherein the cooking appliance constitutes a range.

8. A cooking appliance comprising:

an oven cavity; and a gas burner assembly positioned within the oven cavity, said gas burner assembly being formed from a tubular member having a defined diameter and including a first end, defining an inlet portion, interconnected with a second end, defining an elongated outlet portion, through an intermediate portion, wherein said intermediate portion maintains a vertically spaced relationship between the inlet portion and the outlet portion, said spaced relationship being from 1.0 to 3.33 times the diameter of the tubular member.

9. The cooking appliance according to claim 8, wherein said spaced relationship is from 1.33 to 2.66 times the diameter.

10. The cooking appliance according to claim 9, wherein the spaced relationship equals approximately twice the diameter of the tubular member.

11. The cooking appliance according to claim 8, wherein the diameter equals approximately 0.75 inches (1.91 cm).

12. The cooking appliance according to claim 8, further comprising: a plurality of gas discharge ports arranged along the outlet portion of the gas burner assembly.

13. The cooking appliance according to claim 8, wherein the cooking appliance includes another oven cavity below said oven cavity.

14. The cooking appliance according to claim 13, wherein the cooking appliance constitutes a range.

* * * * *